US007918369B2

(12) United States Patent
Kosmyna et al.

(10) Patent No.: US 7,918,369 B2
(45) Date of Patent: Apr. 5, 2011

(54) TWO-COMPONENT SPRAY GUN WITH SOLVENT FLUSH/BLEND

(75) Inventors: Michael J Kosmyna, Toledo, OH (US); Ralph Wisniewski, Toledo, OH (US)

(73) Assignee: Illinois Tool Works Inc., Glenview, IL (US)

( * ) Notice: Subject to any disclaimer, the term of this patent is extended or adjusted under 35 U.S.C. 154(b) by 862 days.

(21) Appl. No.: 10/254,121

(22) Filed: Sep. 25, 2002

(65) Prior Publication Data

US 2004/0056045 A1 Mar. 25, 2004

(51) Int. Cl.
*B67D 7/78* (2010.01)
*F23D 11/46* (2006.01)

(52) U.S. Cl. ..... 222/145.2; 222/105; 222/145.5; 222/386.5; 239/414

(58) Field of Classification Search ..... 222/94, 222/95, 105, 145.2–145.7, 386.5, 389, 399, 222/394, 325, 335; 239/422, 414, 330
See application file for complete search history.

(56) References Cited

U.S. PATENT DOCUMENTS

| | | | | | |
|---|---|---|---|---|---|
| 817,054 | A | * | 4/1906 | Gay | 604/141 |
| 2,200,675 | A | * | 5/1940 | Northcutt | 137/264 |
| 3,179,341 | A | * | 4/1965 | Plos et al. | 239/414 |
| 3,223,289 | A | * | 12/1965 | Bouet | 222/209 |
| 3,270,920 | A | * | 9/1966 | Nessler | 222/95 |
| 3,541,023 | A | * | 11/1970 | Cole | 422/133 |
| 3,672,544 | A | * | 6/1972 | Marand | 222/94 |
| 4,169,545 | A | | 10/1979 | Decker | |
| 5,143,294 | A | * | 9/1992 | Lintvedt | 239/328 |
| 5,526,957 | A | * | 6/1996 | Brown et al. | 222/94 |
| 5,571,562 | A | * | 11/1996 | Wakat | 427/280 |
| 5,607,082 | A | | 3/1997 | Cracauer et al. | |
| 5,615,803 | A | * | 4/1997 | Hatakeyama et al. | 222/94 |
| 5,622,056 | A | | 4/1997 | Utter et al. | |
| 5,713,519 | A | | 2/1998 | Sandison et al. | |
| 5,816,501 | A | * | 10/1998 | LoPresti et al. | 239/302 |
| 6,533,189 | B2 | * | 3/2003 | Kott et al. | 239/8 |

FOREIGN PATENT DOCUMENTS

| | | | |
|---|---|---|---|
| FR | 626 573 | A | 9/1927 |
| FR | 1 070 911 | A | 8/1954 |
| GB | 2 244 221 | A | 11/1991 |
| JP | 10 181762 | A | 7/1998 |
| JP | 10181762 | | 7/1998 |
| WO | 94/13258 | A | 6/1994 |
| WO | 2004/110643 | A | 12/2004 |

OTHER PUBLICATIONS

EPO Form 1503 from European Search Report.

* cited by examiner

*Primary Examiner* — Kenneth Bomberg
*Assistant Examiner* — Melvin A Cartagena
(74) *Attorney, Agent, or Firm* — Barnes & Thornburg LLP

(57) ABSTRACT

A dispensing system for plural components mixture including second containers placed within a first container. The first container is held by an operator during dispensing. Separate conduits are coupled between the containers and the dispensing device and include passageways for the passage of each respective component. Each passageway includes an actuator controlled valve. A second valve coupled in the conduits between the respective components' sources and includes an inlet port for each component, an equal number of outlet ports, and an inlet port for a material for flushing the plural components from respective conduits and the mixed plural components. The second valve has a first state in which each respective inlet port is coupled to an outlet port. The second valve also has a second state in which the inlet port for flushing the plural components from the respective conduits and the mixed plural components is coupled to the outlet ports.

17 Claims, 14 Drawing Sheets

TWO-COMPONENT SPRAY GUN WITH SOLVENT FLUSH/BLEND

FIELD OF THE INVENTION

This invention relates to dispensing systems for dispensing metered quantities of fluid components. It is disclosed in the context of dispensing systems for dispensing the components, for example, resin and catalyst, of a two component system. However, it is believed to be useful in other applications as well, such as systems for mixing other numbers of components and dispensing the mixed components.

BACKGROUND OF THE INVENTION

Typically, two component (hereinafter sometimes 2K) materials, for example, resin/catalyst systems, are dispensed using special metering and pumping equipment typically costing in the range of $5000 U.S. to $15,000 U.S. This equipment feeds a pressure feed gun through, for example, 35 feet (about 11 meters) of hose. Once a coating operation is concluded, or if the equipment is to sit for any length of time, the hose carrying the mixed components must be flushed before the mixture cures. The cost of flushing solvent and the waste mixed components is about $0.50 U.S. per foot of hose (about $1.65 U.S. per meter of hose).

DISCLOSURE OF THE INVENTION

According to a first aspect of the invention, a dispensing system includes a first container, a dispensing device and at least one flexible container for a respective at least one component to be dispensed. The flexible container or containers is or are adapted to be placed within the first container. A respective conduit is coupled between each flexible container and the dispensing device.

Illustratively according to this aspect of the invention, the first container is hand-held.

Further illustratively according to this aspect of the invention, the apparatus includes a second container for a solvent for the mixed plural components. Illustratively, the second container is mounted on the dispensing device.

Additionally illustratively according to this aspect of the invention, the flexible containers comprise sealable resin or polymer bags.

Illustratively according to this aspect of the invention, the flexible containers come prepackaged from a supplier.

Alternatively illustratively according to this aspect of the invention, the flexible containers are filled by the operator of the apparatus.

Illustratively according to this aspect of the invention, the first container includes a closure having a first connector for each of the plural components. Each flexible container includes a complementary second connector for cooperating with a respective first connector to couple the material in a respective flexible container to the dispensing device.

Further illustratively according to this aspect of the invention, the apparatus includes means for pumping the components from their flexible containers through their respective conduits to the dispensing device.

Additionally illustratively according to this aspect of the invention, the means for pumping the components from their flexible containers through their respective conduits to the dispensing device includes means for pressurizing the first container.

Illustratively according to this aspect of the invention, the means for pressurizing the first container includes means for supplying to the interior of the first container a compressed gas or mixture of gases.

Further illustratively according to this aspect of the invention, the apparatus includes a valve and a second container. The valve controls the supply of a material from the second container to purge the plural components from the dispenser.

According to another aspect of the invention, a dispensing system for a plural component mixture includes a first container, a dispensing device, and second containers for each of the components. The second containers are adapted to be placed within the first container. Conduits are provided for coupling the second containers and the dispensing device. The first container is adapted to be held by an operator during dispensing of plural component mixture from the dispensing device.

Illustratively according to this aspect of the invention, the second containers for each of the components comprise separate flexible containers.

Further illustratively according to this aspect of the invention, the separate flexible containers comprise sealable resin or polymer bags.

Additionally illustratively according to this aspect of the invention, the separate flexible containers come prepackaged from a supplier.

Alternatively illustratively according to this aspect of the invention, the separate flexible containers are filled by the operator of the apparatus.

Illustratively according to this aspect of the invention, the first container includes a closure having a first connector for each of the plural components. Each second container includes a complementary second connector for cooperating with a respective first connector to couple the material in a respective second container to the dispensing device.

Further illustratively according to this aspect of the invention, the apparatus includes means for pumping the components from their separate second containers through their respective separate conduits to the dispensing device.

Additionally illustratively according to this aspect of the invention, the second containers for each of the components comprise separate flexible containers. The means for pumping the components from their separate second containers through their respective separate conduits to the dispensing device includes means for pressurizing the first container.

Illustratively according to this aspect of the invention, the means for pressurizing the first container includes means for supplying to the interior of the first container a compressed gas or mixture of gases.

Further illustratively according to this aspect of the invention, the apparatus includes a valve and a second container. The valve controls the supply of a material from the second container to purge the plural components from the dispenser.

According to another aspect of the invention, a dispensing system for a plural component mixture includes a dispensing device, first containers for each of the components, and conduits coupled between respective first containers and the dispensing device. The dispensing device includes a passageway for the passage of each respective component through the dispensing device. Each passageway includes a valve. An actuator controls the valves, thereby controlling the passage of the respective components through the dispensing device.

Illustratively according to this aspect of the invention, each valve includes a seat and a movable valve member. The actuator controls the positions of the movable valve members.

Further illustratively according to this aspect of the invention, the apparatus includes a second container. The first containers comprise separate flexible containers. Means are included for pumping the components from their separate flexible containers through their respective separate conduits to the dispensing device.

Additionally illustratively according to this aspect of the invention, the separate flexible containers comprise sealable resin or polymer bags.

Illustratively according to this aspect of the invention, the means for pumping the components from their separate flexible containers through their respective separate conduits to the dispensing device includes means for pressurizing the first container.

Additionally illustratively according to this aspect of the invention, the means for pressurizing the first container includes means for supplying to the interior of the first container a compressed gas or mixture of gases.

Further illustratively according to this aspect of the invention, the apparatus includes a valve and a second container. The valve controls the supply of a material from the second container to purge the plural components from the dispenser.

Illustratively according to this aspect of the invention, the second container is hand-held.

According to yet another aspect of the invention, a dispensing system for a plural component mixture includes a dispensing device, a source for each of the components, and conduits coupled between respective component sources and the dispensing device. Valve means is coupled in the conduits between the respective component sources and the dispensing device. The valve means includes an inlet port for each component, an equal number of outlet ports, and an inlet port for a material for flushing the plural components from at least portions of their respective conduits and the mixed plural components from the dispensing device. The valve means has a first state in which each inlet port for a respective one of the plural components is coupled to an outlet port to provide the plural components to the dispensing device when the valve means is in the first state. The valve means also has a second state in which the inlet port for the material for flushing the plural components from at least portions of the respective conduits and the mixed plural components from the dispensing device is coupled to the outlet ports.

Illustratively according to this aspect of the invention, the valve means is mounted on the dispensing device.

Further illustratively according to this aspect of the invention, the dispensing device includes a pistol-grip-like handle. The valve means is mounted on the pistol-grip-like handle.

Additionally illustratively according to this aspect of the invention, the dispensing device includes a passageway for the passage of each respective component through the dispensing device. The conduits are coupled between the respective component sources and the respective passageways for the passage of each respective component through the dispensing device.

Illustratively according to this aspect of the invention, each passageway includes a valve. An actuator controls the valves, thereby controlling the passage of the respective components through the dispensing device.

According to another aspect of the invention, a dispensing system for a plural component mixture includes a first container, a dispensing device and separate containers for each of the components. The separate containers are adapted to be placed within the first container. Conduits couple the separate containers and the dispensing device. Means are provided for pressurizing the interior of the first container, thereby exposing the surfaces of the components in the separate containers to the pressure within the first container to draw the components through their respective conduits.

Illustratively according to this aspect of the invention, the first container is hand-held.

Further illustratively according to this aspect of the invention, the apparatus includes a second container for a solvent for the mixed plural components. The second container is mounted on the dispensing device.

Illustratively according to this aspect of the invention, the separate containers are filled with respective components by a supplier.

Alternatively illustratively according to this aspect of the invention, the separate containers are filled by the operator of the apparatus.

Illustratively according to this aspect of the invention, the means for pressurizing the first container includes means for supplying to the interior of the first container a compressed gas or mixture of gases.

Further illustratively according to this aspect of the invention, the apparatus includes a valve and a second container. The valve controls the supply of a material from the second container to purge the plural components from the dispenser.

According to another aspect of the invention, a dispensing system for a plural component mixture includes a flexible outer container, a dispensing device and separate flexible inner containers for each of the components. The flexible inner containers are adapted to be placed within the flexible outer container. Conduits couple the flexible inner containers and the dispensing device.

Illustratively according to this aspect of the invention, the flexible outer container is hand-held.

Additionally illustratively according to this aspect of the invention, one of the flexible inner containers is a flexible inner container for a solvent for the mixed plural components.

Illustratively according to this aspect of the invention, the flexible inner containers comprise sealable resin or polymer bags.

Illustratively according to this aspect of the invention, the flexible inner containers are filled with respective components by a supplier.

Alternatively illustratively according to this aspect of the invention, the flexible inner containers are filled by the operator of the apparatus.

Additionally illustratively according to this aspect of the invention, the flexible outer container includes a closure having a first connector for each of the plural components. Each flexible inner container includes a complementary second connector for cooperating with a respective first connector to couple the material in a respective flexible inner container to the dispensing device.

Further illustratively according to this aspect of the invention, the apparatus includes means for pumping the components from their flexible inner containers through their respective conduits to the dispensing device.

Illustratively according to this aspect of the invention, the means for pumping the components from their flexible containers through their respective conduits to the dispensing device includes means for pressurizing the flexible outer container.

Additionally illustratively according to this aspect of the invention, the means for pressurizing the flexible outer container includes means for supplying to the interior of the flexible outer container a compressed gas or mixture of gases.

Further illustratively according to this aspect of the invention, the apparatus includes a valve and a second container. The valve controls the supply of a material from the second container to purge the plural components from the dispenser.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
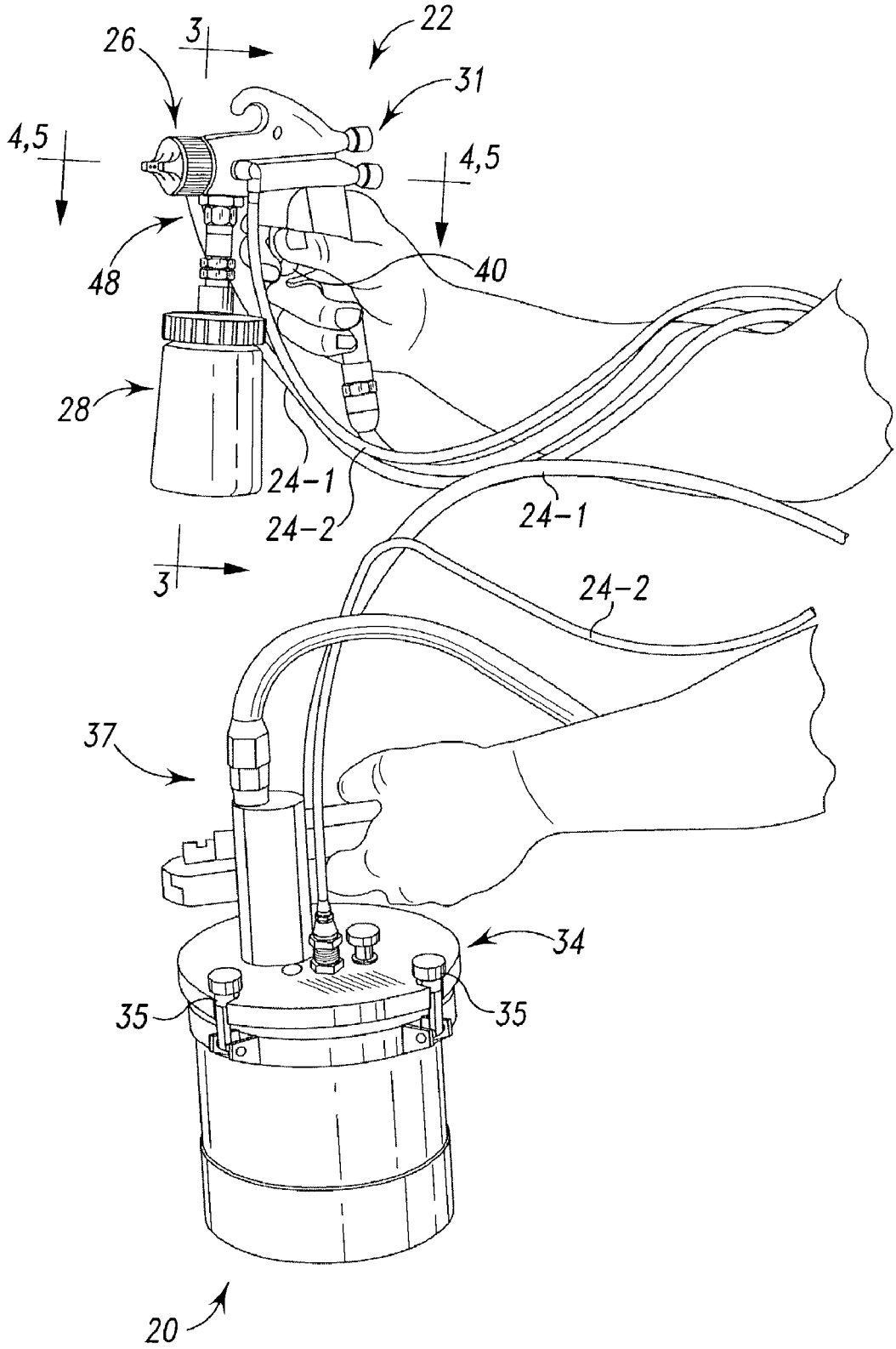
FIG. 1 illustrates a side view of a plural component dispensing system constructed according to the invention.
Figure 2:
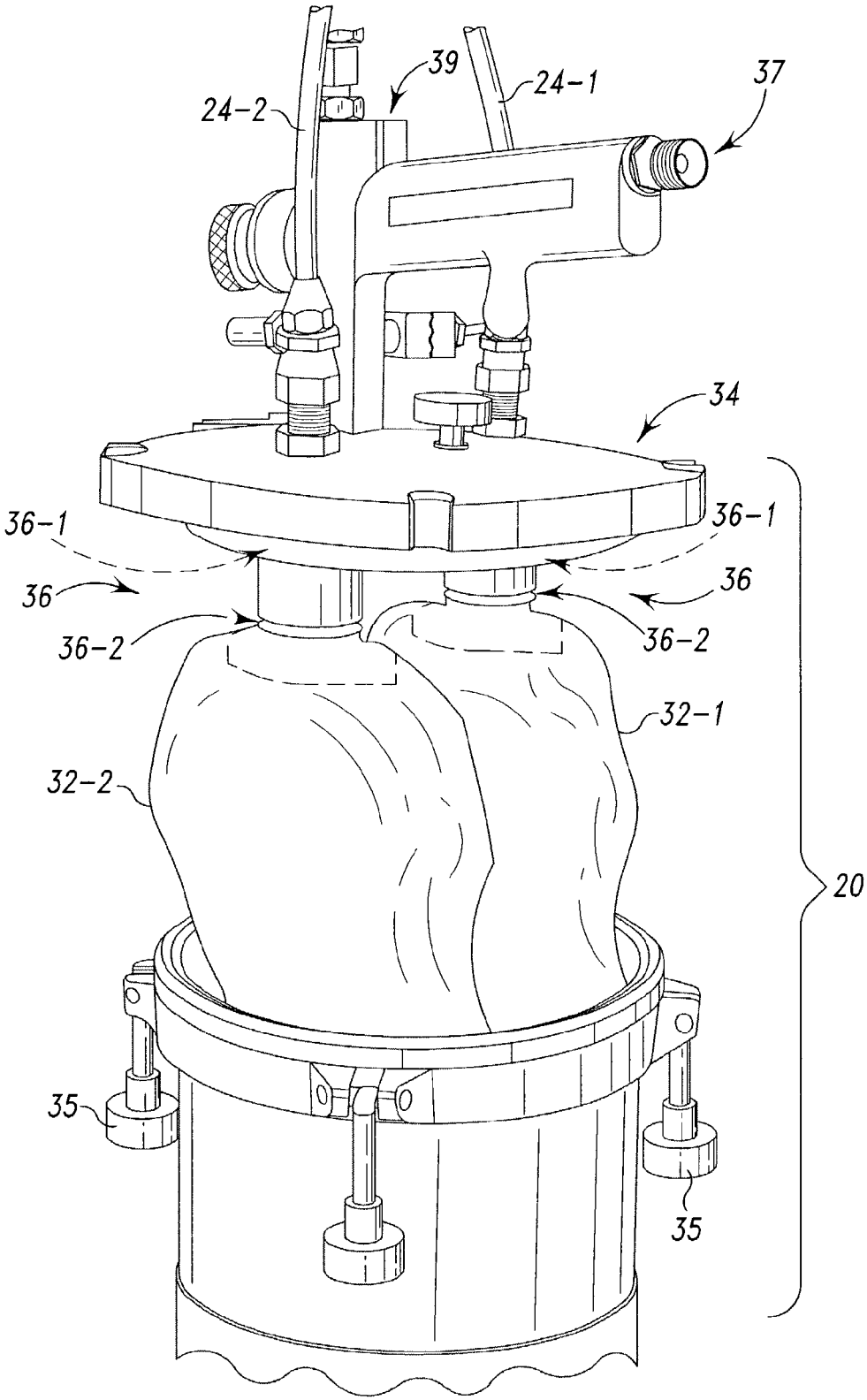
FIG. 2 illustrates a side view of a detail of the system illustrated in FIG. 1 in an open orientation.
Figure 2A:
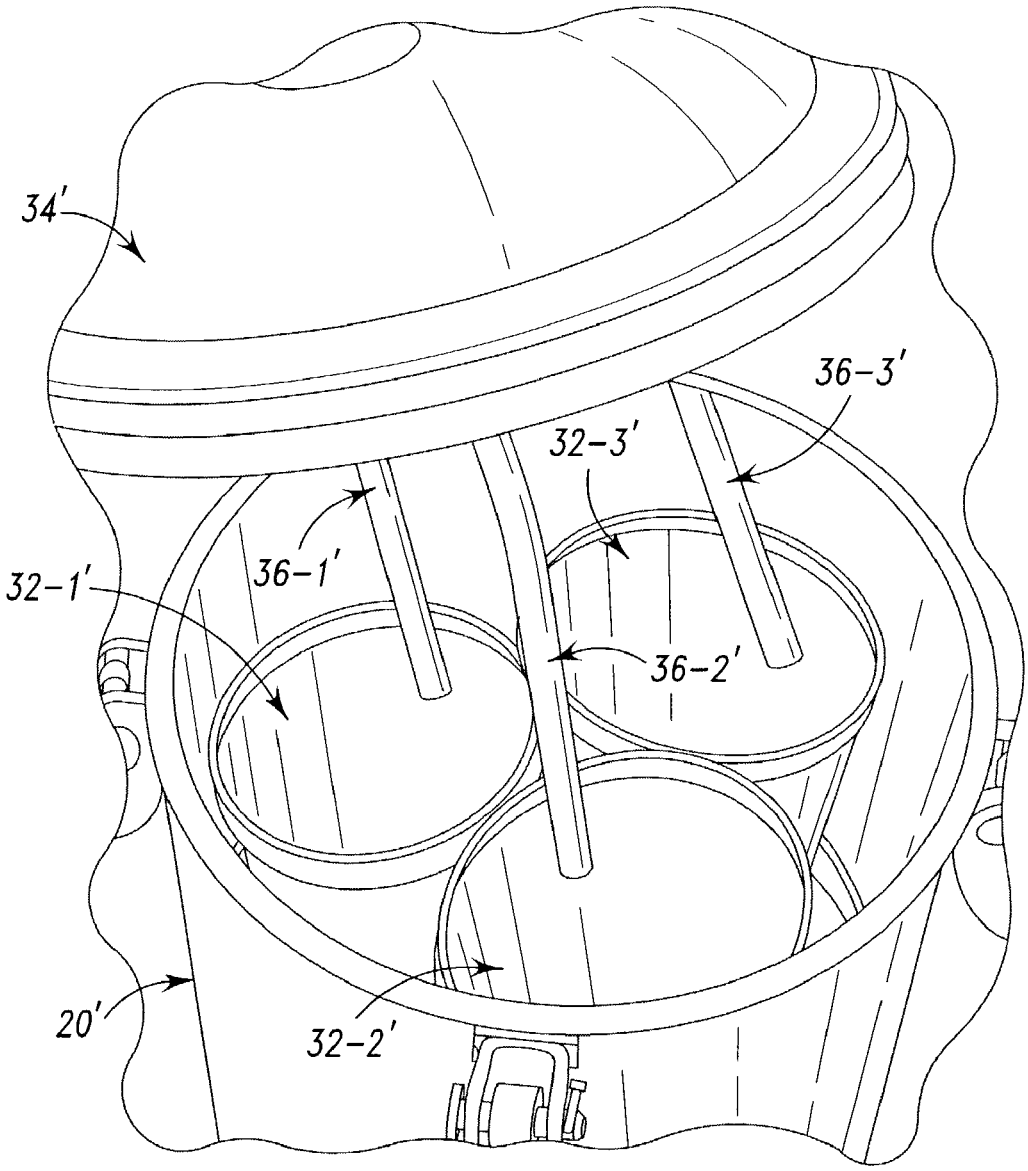
FIGS. 2*a-b* illustrate side views of alternative details to the detail illustrated in FIG. 2.
Figure 2B:
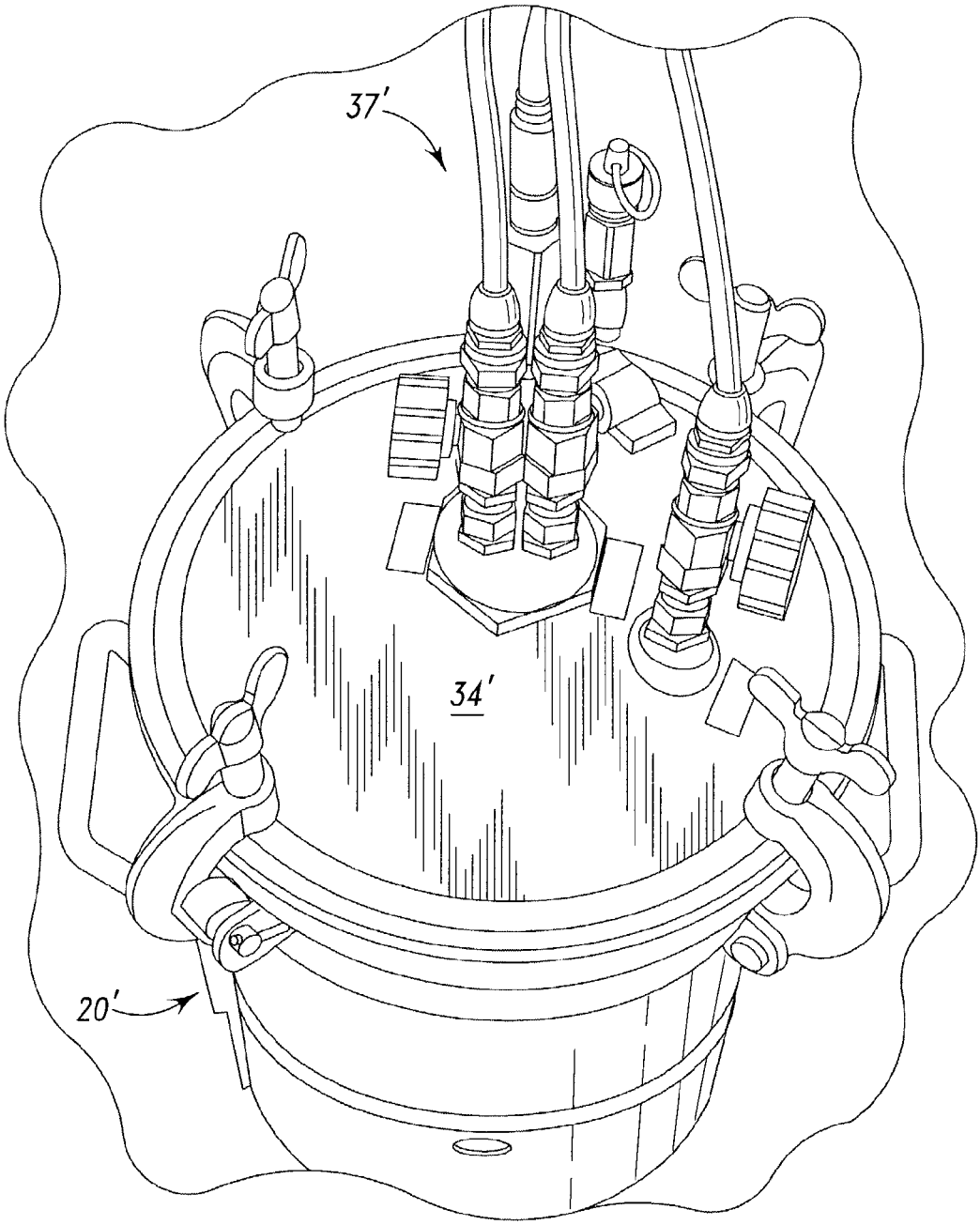
Figure 9:
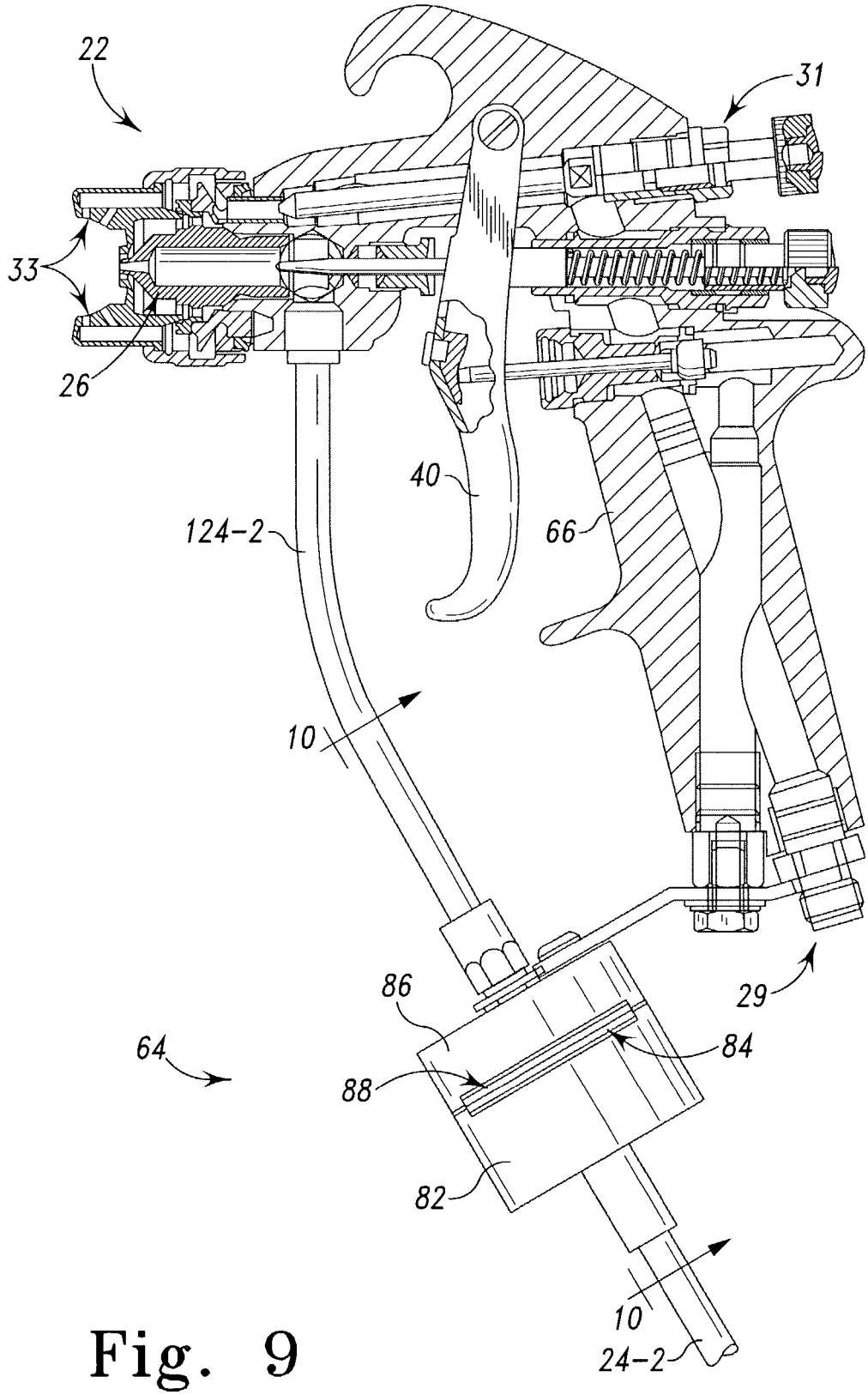
FIG. 9 illustrates a partial sectional side elevational view of the apparatus illustrated in FIG. 8, taken generally along section lines 9-9 of FIG. 8.
Figure 10:
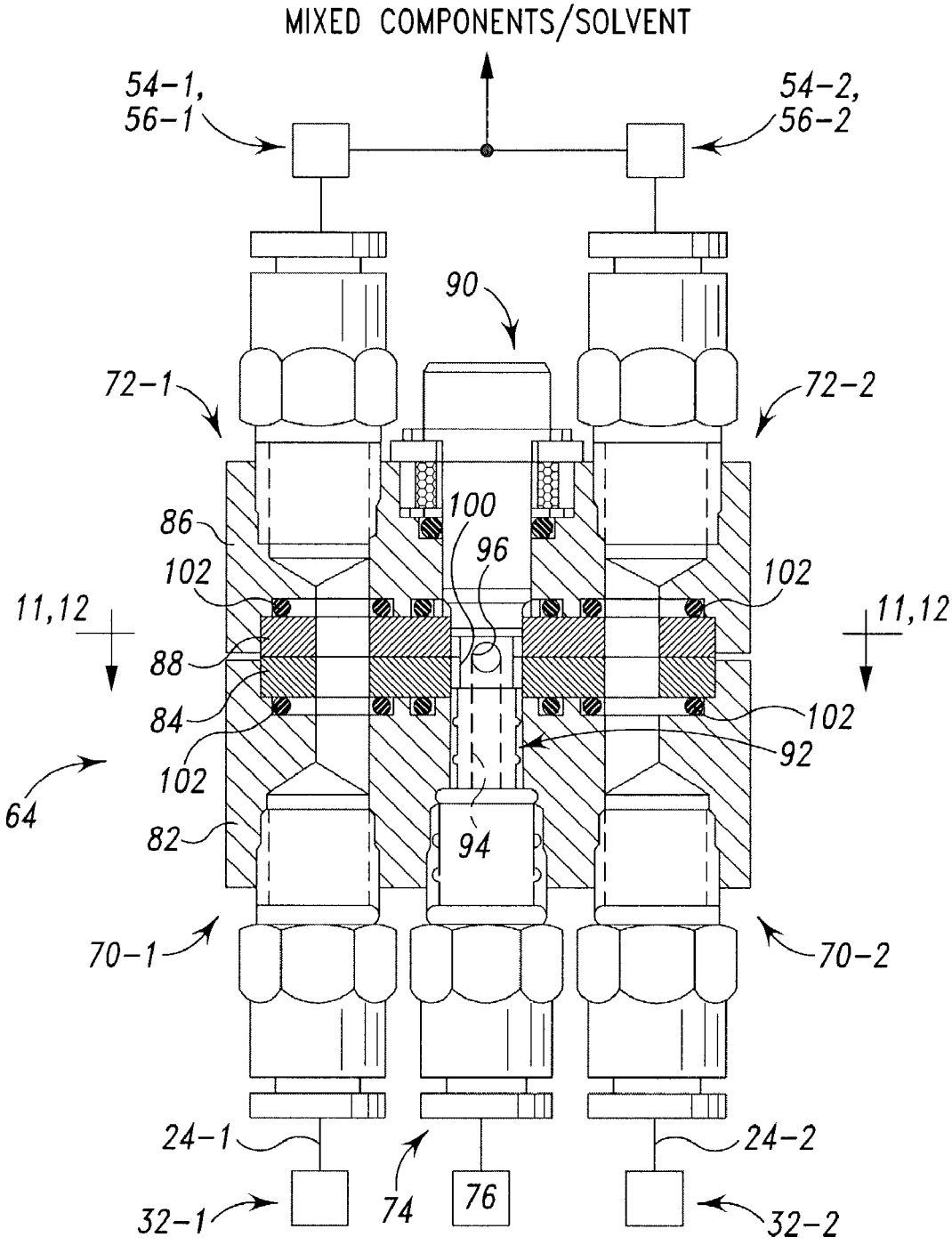
FIG. 10 illustrates a sectional view of a detail of the component illustrated in FIGS. 8-9 taken generally along section lines 10-10 of FIG. 9.
Figure 11:
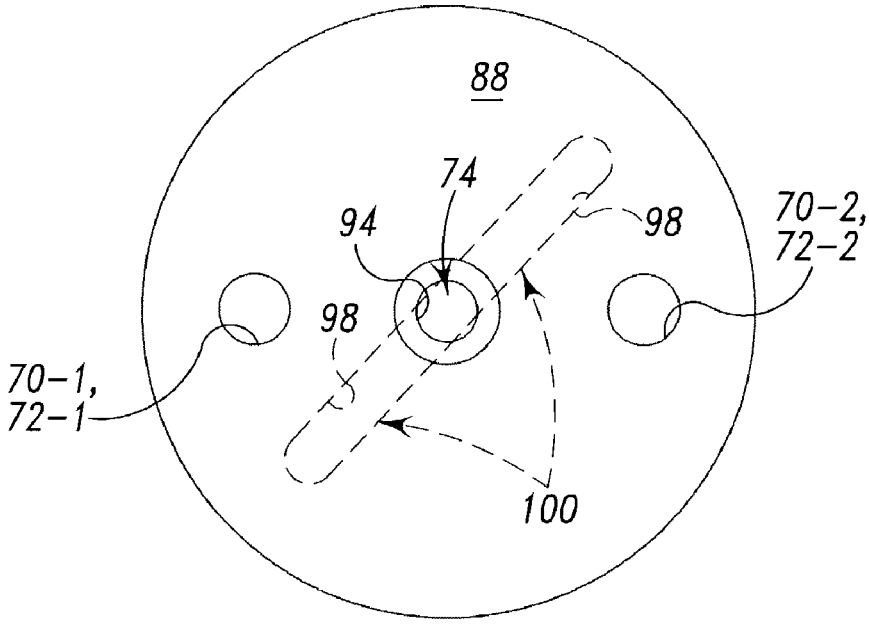
FIG. 11 illustrates a sectional view of the detail illustrated in FIG. 10 taken generally along section lines 11, 12-11, 12 of FIG. 10; and, FIG. 12 illustrates a sectional view of the detail illustrated in FIGS. 10-11 taken generally along section lines 11, 12-11, 12 of FIG. 10 in another orientation.
Figure 12:
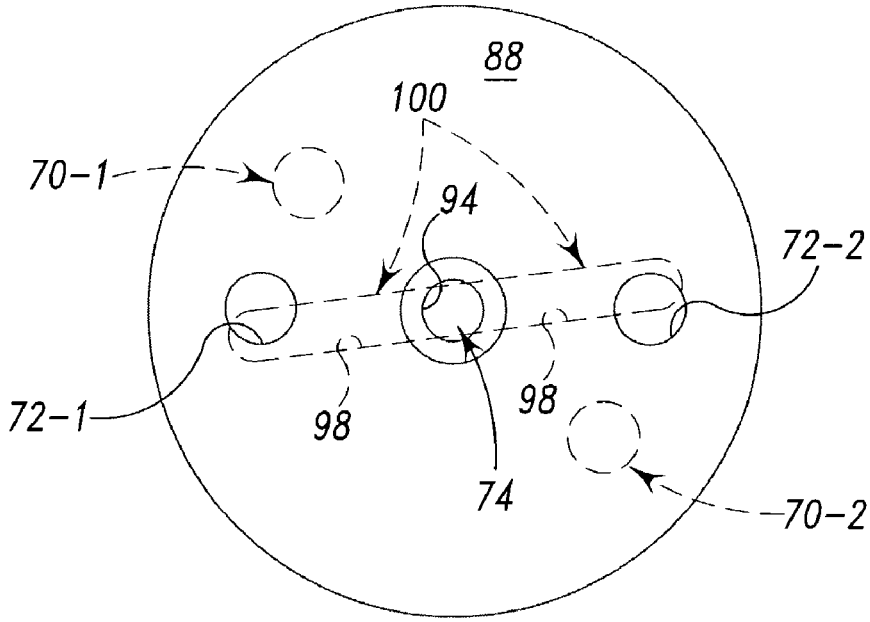

Referring now to the drawings, and particularly to FIGS. 1-2, the individual components of a 2K material are supplied from a separate container 20, which may be hand-held, and fed to a dispensing device 22, hereinafter sometimes referred to as a gun, through separate conduits 24-1, 24-2, such as hoses. The components are mixed in the gun 22's fluid tip 26. After spraying, the catalyzed material in the fluid tip 26 is flushed using solvent from a container 28 that may be attached to the gun 22. Solvent can also be dispensed through gun 22 to blend any dry edges of a spray pattern for repairing the spray pattern. Gun 22 is also provided with compressed air or other gas or combination of gases through a fitting 29. A separate control 31, FIG. 9, is provided to control the flow of compressed air from a pair of diametrically opposed air horns 33 on fluid tip 26. This air flow helps to shape the pattern of the sprayed mixed components.

The two components, such as, for example, a clear or pigmented resin and an activator, are dispensed from, for example, separate sealable resin or polymer bags 32-1, 322. These bags 32-1, 32-2 can, for example, come prepackaged from the supplier(s) of the components, or can be filled by the operator on the job. The bags 32-1, 32-2 are attached to the closure 34 of container 20, for example, by quick connects 36. As the bags 32-1, 32-2 are loaded into the container 20, the container closure 34's quick connect 36-1 pierces a hole in a respective bag 32-1's or 32-2's quick connect 36-2 to couple the material in the bag 32-1, 32-2 to the gun 22. The closure 34 is then latched 35 to the container 20 and the container 20 is pressurized, for example, by supplying compressed air or other gas or combination of gases which is (are) relatively inert to the materials from which the bags 32-1, 32-2 are made. Illustratively, the compressed gas is provided to the interior of container 20 though a fitting 37 on a carrying handle 39 provided on closure 34.

Referring to FIGS. 2*a-d*, other configurations may be employed. For example, and referring particularly to FIGS. 2*a-b*, two, three, or more components can be placed into open, rigid containers 32-1', 32-2', . . . 32-*n*'. Open, rigid containers 32-1', 32-2', . . . 32-*n*' are then placed inside another rigid container 20'. A closure 34' of rigid container 20' is provided with feed tubes 36-1', 36-2', . . . 36-*n*' which project into open, rigid containers 32-1', 32-2', . . . 32-*n*' below the surfaces of the various components in containers 32-1', 32-2', . . . 32-*n*' when the closure 34' is sealed onto rigid container 20'. Rigid container 20' is then pressurized through an appropriate fitting 37', and the pressure on the surfaces of the components in the open rigid containers 32-1', 32-2', . . . 32-*n*' forces the components through the gun 22 when their respective valves on the gun 22 are opened.

Figure 2C:
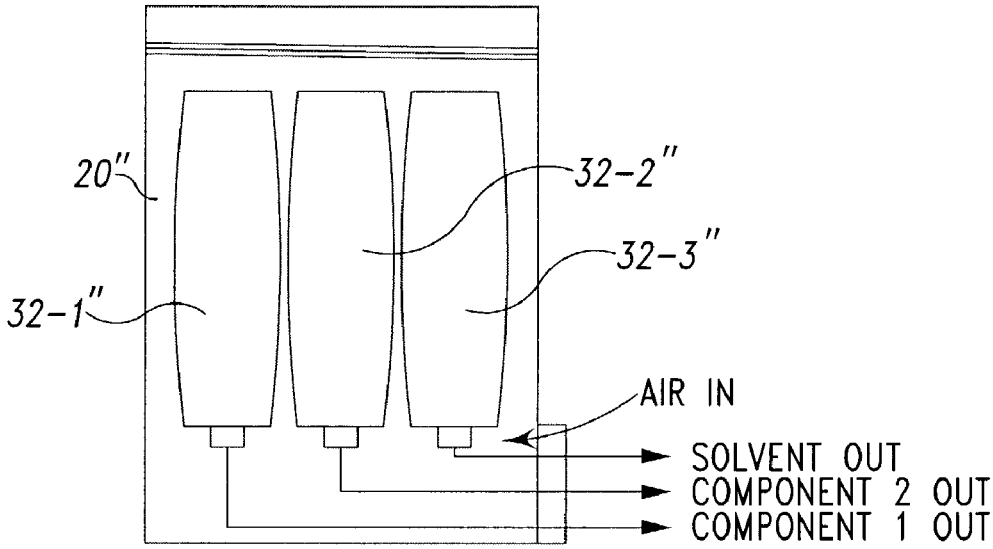
FIGS. 2*c-d* illustrate perspective views of alternative details to the details illustrated in FIGS. 2, 2*a* and 2*b;*
Figure 2D:
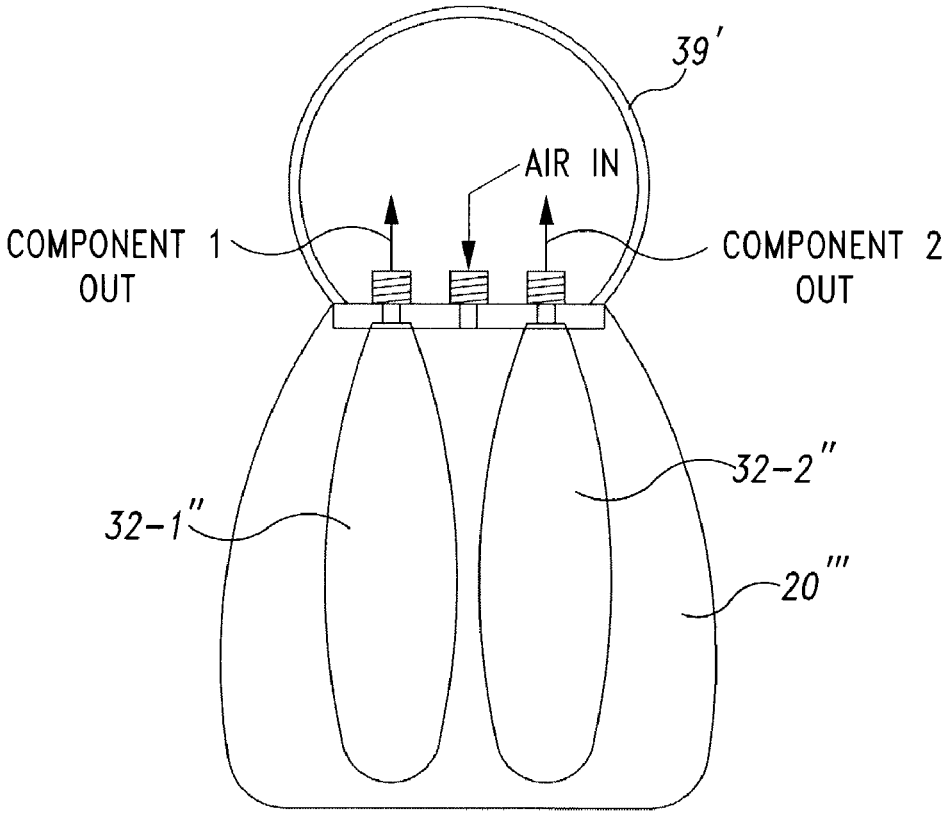
Figure 3:
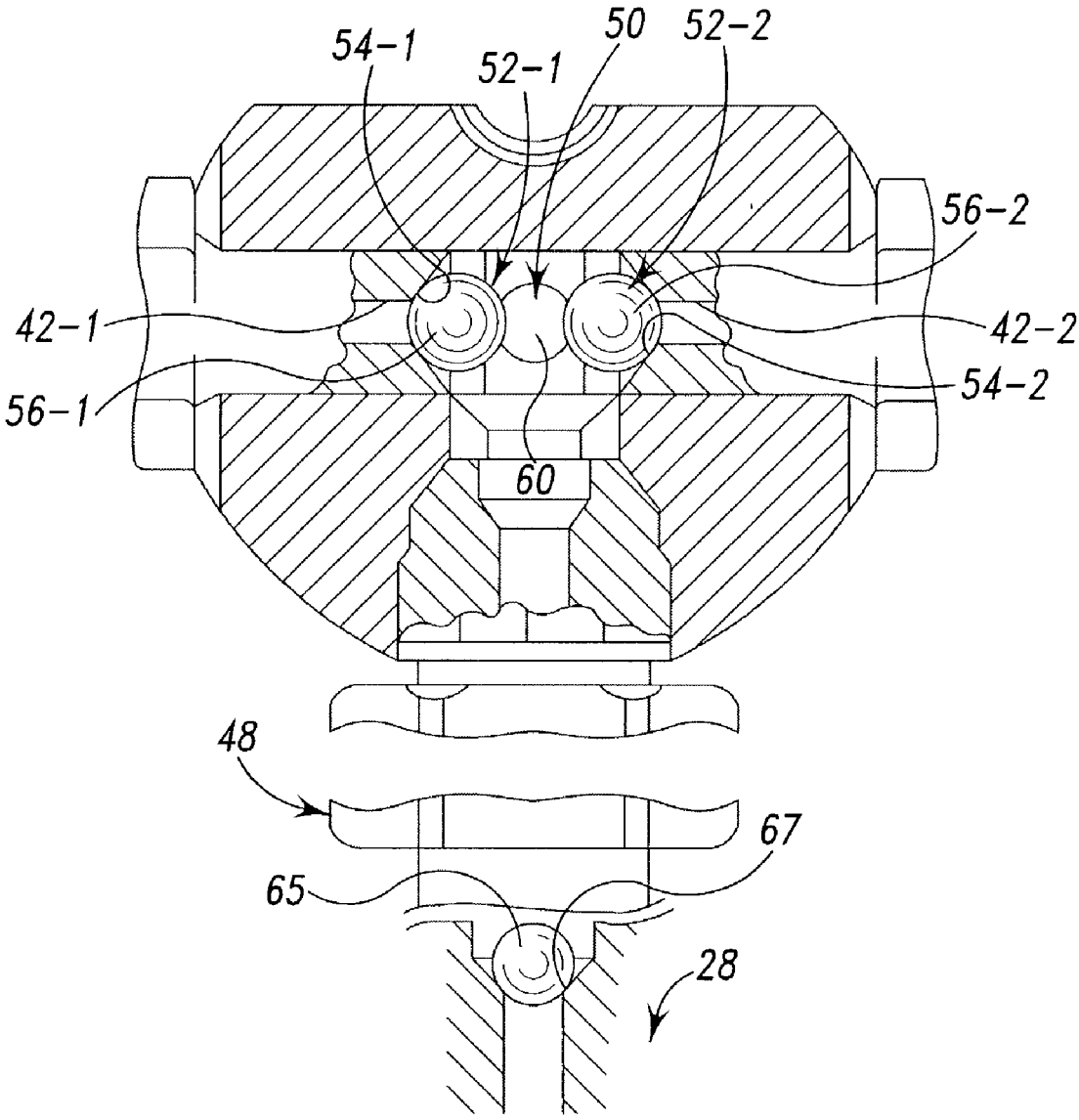
FIG. 3 illustrates a vertical sectional view of the system illustrated in FIGS. 1-2, taken generally along section lines 3-3 of FIG. 1.
Figure 4:
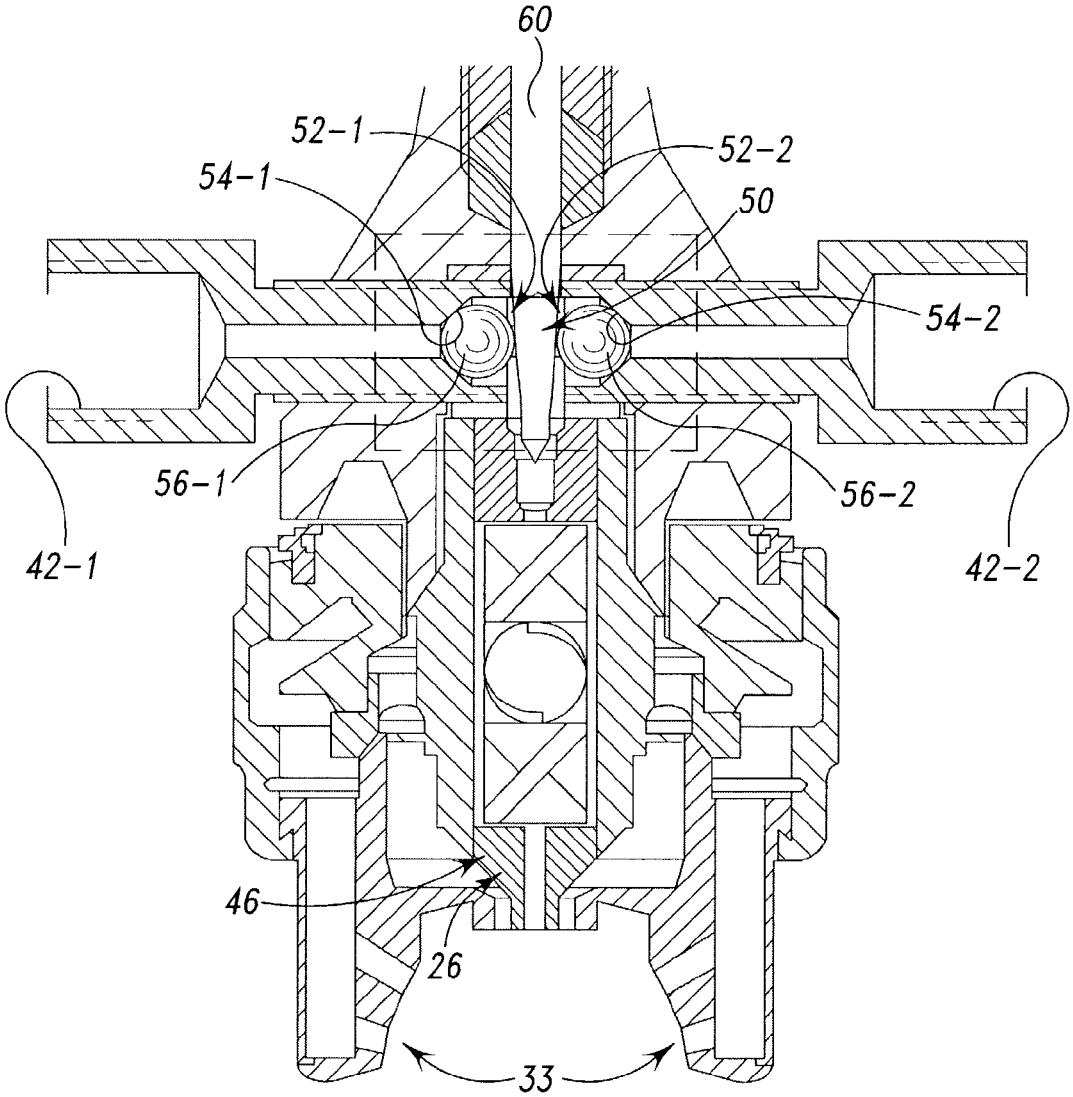
FIG. 4 illustrates a fragmentary horizontal sectional view of a detail of the system illustrated in FIGS. 1-3, taken generally along section lines 4, 5-4, 5 of FIG. 1, with the detail illustrated in a first orientation.
Figure 5:
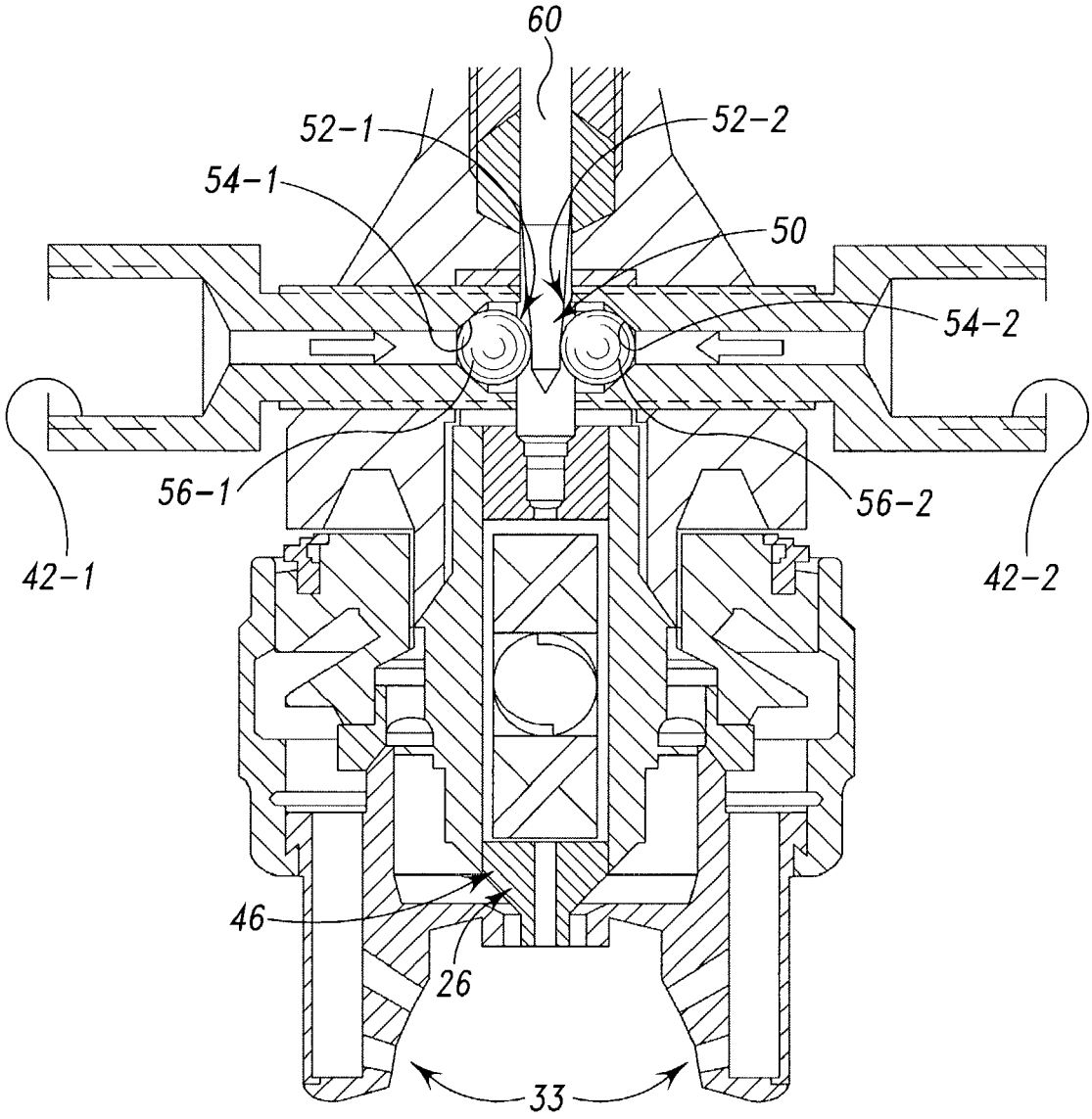
FIG. 5 illustrates a fragmentary horizontal sectional view of a detail of the system illustrated in FIGS. 1-3, taken generally along section lines 4, 5-4, 5 of FIG. 1, with the detail illustrated in a second orientation.
Figure 6:
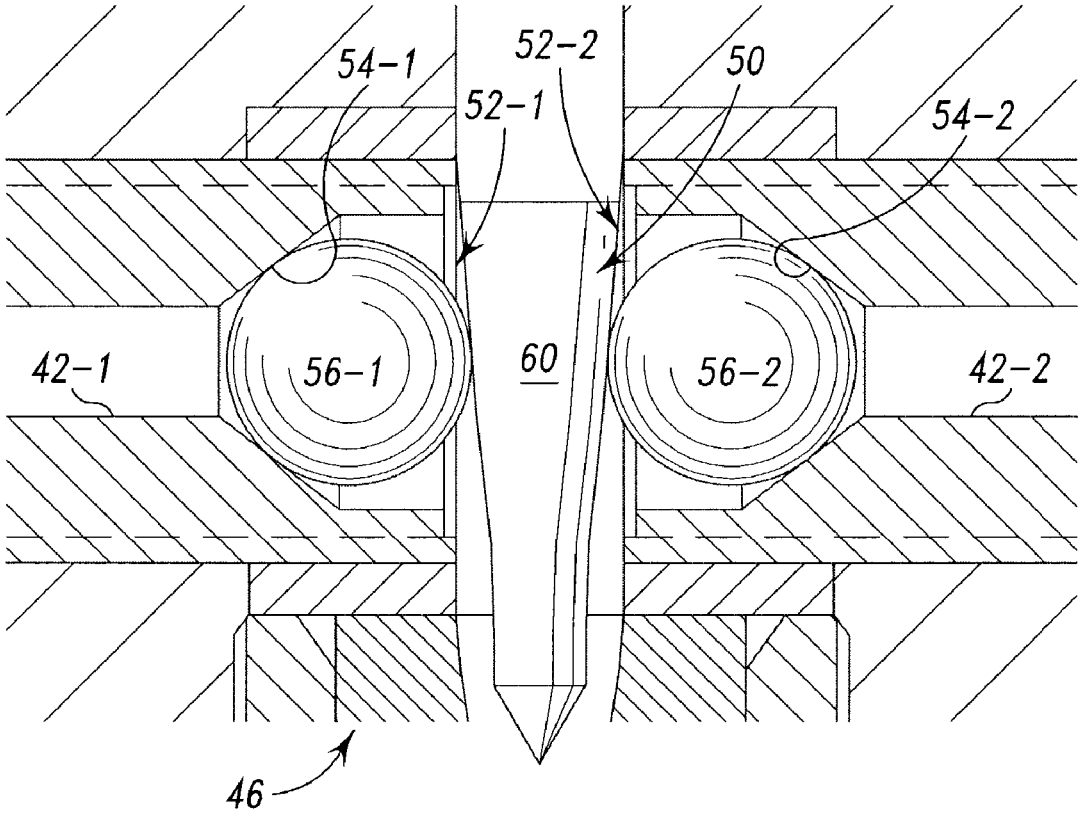
FIG. 6 illustrates a much enlarged view of a detail of FIG. 4.
Figure 7:
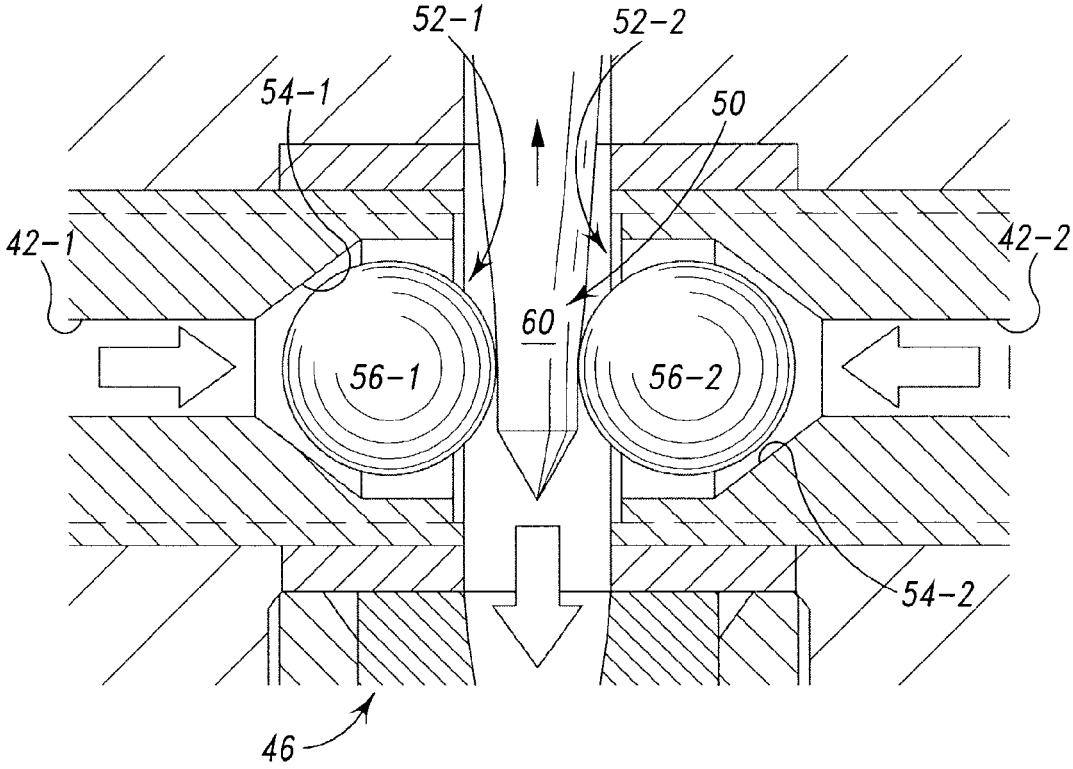
FIG. 7 illustrates a much enlarged view of a detail of FIG. 5.
Figure 8:
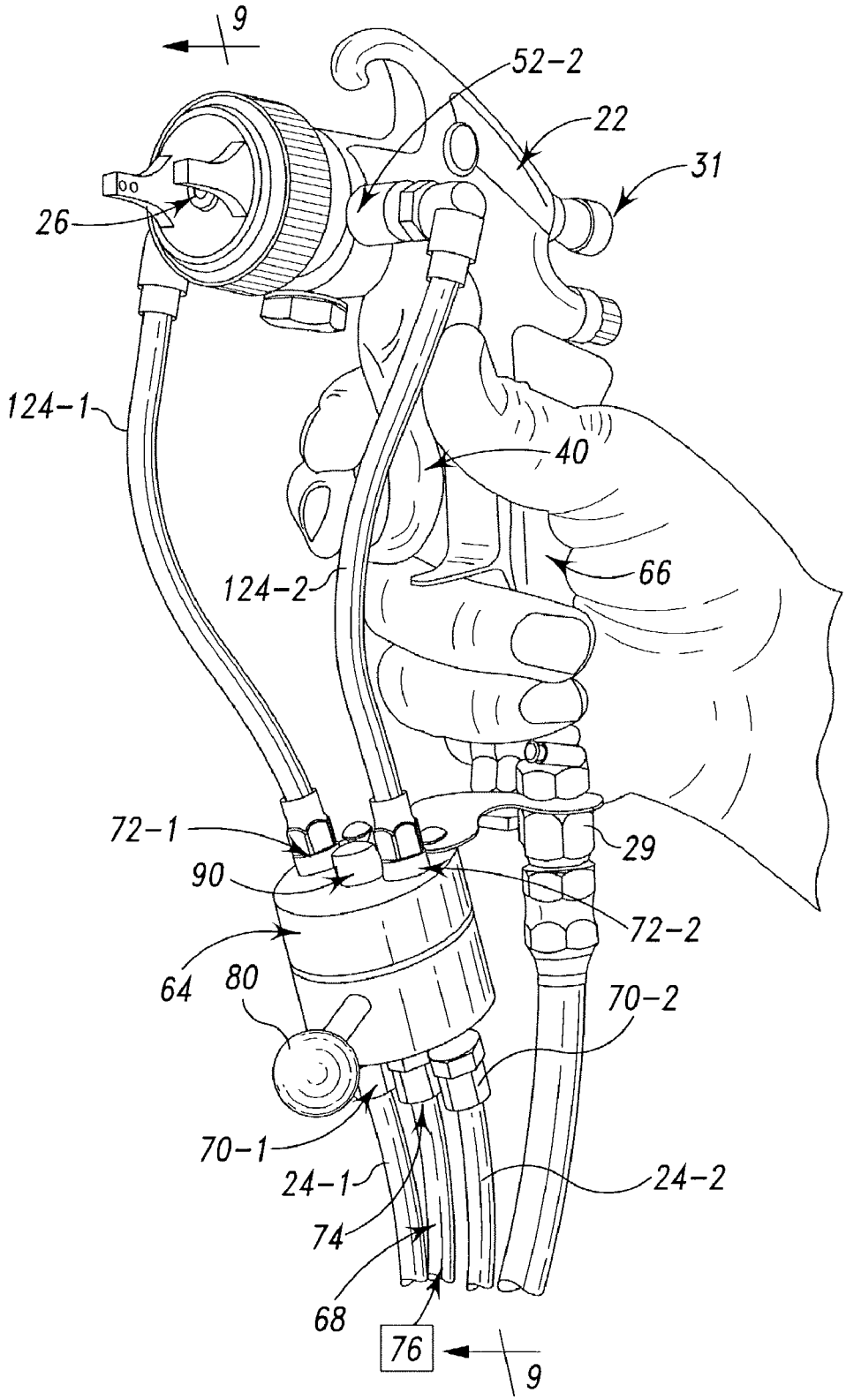
FIG. 8 illustrates a perspective view, from the front and side, of another embodiment of a component constructed according to the invention.

In other embodiments illustrated in FIGS. 2*c-d*, the containers 32-1", 32-2", . . . 32-*n*" for the various components, resin, activator and solvent in FIG. 2*c* and resin and activator in FIG. 2*d*, are flexible bags which are relatively inert to their respective contents. The flexible bags 32-1", 32-2", . . . 32-*n*" are inside another flexible bag, 20" in FIG. 2*c* and 20'" in FIG. 2*d*, which is capable of being pressurized from a source of compressed air or other gas or combination of gases. Pressurization of the bag 20", 20'" permits dispensing of the contents of the bags 32-1", 32-2", . . . 32-*n*" when their respective valves on a gun 22 are opened. Of course, bags 20", 20'", 32-1, 32-2, 32-1", 32-2", . . . 32-*n*" must be sufficiently durable to withstand pressurization to the pressures required for dispensing the components contained in bags 32-1, 32-2, 32-1", 32-2", . . . 32-*n*" in a particular application. As illustrated in FIG. 2*d*, bags 20", 20'" can be provided with carry straps 39'.

Referring now to FIGS. 3-7, when the gun 22's trigger 40 is actuated, the compressed gas forces the materials from the bags 32-1, 32-2 through the hoses 24-1, 24-2 to respective passageways 42-1, 42-2 in the fluid tip 26. The two components flow together in the fluid tip 26. The components are mixed with the aid of a static mixer 46 in the tip 26. A separate valve 48 is provided for solvent.

The passageways 42-1, 42-2 inside the fluid tip 26 terminate at a mixing chamber 50. At the ports 52-1, 52-2 of the passageways 42-1, 42-2 into the mixing chamber 50, each passageway 42-1, 42-2 includes a seat 54-1, 54-2 for a respective valve ball 56-1, 56-2. A valve needle 60, the position of which is controlled by the position of the gun 22's trigger 40, controls the positions of the balls 56-1, 56-2 with respect to their respective seats 54-1, 54-2.

As needle 60 is retracted rearwardly, balls 56-1, 56-2 are freed to retract from their respective seats 54-1, 54-2, resulting in the dispensing of components from passageways 42-1, 42-2 into the stream of compressed air. Then, as spraying is completed and pressure on trigger 40 is released, balls 56-1, 56-2 are forced by the forwardly moving needle 60 back onto their seats 54-1, 54-2, shutting off the flows of the components through ports 52-1, 52-2. When an air spray gun 22 is triggered, the air valve opens first to provide a flow of atomizing air. As the trigger 40 is pulled back further, the fluid needle 60 is retracted rearward. To spray solvent alone, valve 48 is opened and the trigger 40 is only pulled back enough to open the air valve. The flow of air lifts ball 65 off its seat 67 and solvent is atomized from solvent container 28 into the air stream. If the trigger 40 is then pulled back far enough to free balls 56-1, 56-2 from their respective seats 54-1, 54-2, solvent and components are dispensed together.

Referring now to FIGS. 8-12, alternatively, or in combination with various features of the construction described above, separate conduits 124-1, 124-2, such as hoses, can be provided to the ports 52-1, 52-2 from a valve 64 mounted on a pistol-grip-type handle 66 of the gun 22. Hoses 24-1, 24-2 are provided for each component to the valve 64. Valve 64 includes an inlet port 70-1, 70-2 for each component, an equal number of outlet ports 72-1, 72-2, and an inlet port 74 for solvent. Valve 64 has a first state in which each inlet port 70-1, 70-2 is coupled to a respective outlet port 72-1, 72-2 to provide the plural components to the gun 22 when valve 64 is in the first state. Valve 64 also has a second state in which solvent inlet port 74 is coupled to all of the outlet ports 72-1, 72-2 to couple solvent from a source 76 of solvent for flushing the plural components from the respective conduits 124-1, 124-2 and the mixed plural components from the dispensing device 22.

Valve 64 includes a movable valve plate 82 and movable valve disk 84 and a fixed valve plate 86 and fixed valve disk 88. The fixed valve plate 86 and disk 88 are pivotally coupled to the movable valve plate 82 and disk 84 about the axis of the valve 64 which is the axis of a pivot pin 90. The disks 84, 88 are constructed from highly abrasion-resistant materials, for example, ceramic, and their facing surfaces are smooth (for example, within 4 Ra=1 μm) and flat (for example, within one light band). This avoids the need for seals such as O-ring seals between these surfaces to seal the various ports provided in them. The distal end 92 of pivot pin 90 is threaded to engage threads provided in movable valve plate 82. Distal end 92 includes an axial passageway 94 and a transverse passageway 96 which form part of the solvent inlet port 74.

The fixed valve disk 88 is fixed relative to the fixed valve plate 86. The movable valve disk 84 moves with the movable valve plate 82. The inlet ports 70-1, 70-2, 74 are provided through the movable valve plate 82 and disk 84. The outlet ports 72-1, 72-2 are provided through the fixed valve plate 86 and disk 88. The disks 84, 88 seal against each other to reduce the likelihood of leakage of the components and solvent past them. Movable valve disk 84 further includes a diametrically extending slot 98 forming a transverse passageway 100 which permits coupling of the solvent inlet port 74 to both outlet ports 72-1, 72-2 when valve 64 is in the appropriate orientation, illustrated in FIG. 12. O-ring seals 102 of (a) suitable material(s) which is (are) relatively inert to the components and solvent are also provided at appropriate locations in the valve 64 structure.

A conduit 68 is provided for coupling the solvent from source 76 to the valve 64. The valve 64 is movable between its first and second states by manipulation by the operator of a handle 80 on movable valve plate 82. When valve 64 is in the first state, the hoses 24-1, 24-2 for the components from their sources 32-1, 32-2 are coupled through respective hoses 124-1, 124-2 from valve 64 to respective valves 54-1, 56-1; 54-2, 56-2. In the second state of valve 64, the hoses 24-1, 24-2 for the various components are disconnected from hoses 124-1, 124-2, and the solvent conduit 68 is coupled through the valve 64 to all of the hoses 124-1, 124-2.

Thus, when the valve 64 is in this position coupling the solvent conduit 68 to all of the hoses 124-1, 124-2, the source 76 of solvent is coupled through all of the hoses 124-1, 124-2 to all of the valves 54-1, 56-1; 54-2, 56-2. When the trigger 40 is actuated with valve 64 in this position, the source 76 of solvent is coupled to all of the ports 52-1, 52-2 in the fluid tip 26, permitting the solvent to flush out any remaining amounts of the components from their respective hoses 124-1, 124-2 and ports 52-1, 52-2, and to flush out any mixed components remaining in the mixing chamber 50 and elsewhere in the fluid tip 26.

Although the passageways 42-1, 42-2, ports 52-1, 52-2, seats 54-1, 54-2 and balls 56-1, 56-2 are illustrated as being the same size, it should be understood that it may be desirable to mix different ratios of the components than about 1:1, which would be the ratio with the components illustrated in the drawings. Among the ways of achieving different ratios are making the cross-sectional areas of any one or more of: the passageways 42-1, 42-2; ports 52-1, 52-2; and, seats 54-1, 54-2 and balls 56-1, 56-2 different to provide the desired ratios. For example, the seats 54-1, 54-2 and balls 56-1, 56-2 could be provided in removable, replaceable kits corresponding to different desired ratios of the components to be dispensed through passageways 42-1, 42-2, respectively. Different ratios can also be obtained by (a) flow restrictor(s) in one or more of the hoses 24-1, 24-2, 124-1, 124-2, passageways 42-1, 42-2, and/or ports 52-1, 52-2, or elsewhere in the flow paths of the various components from their sources 32-1, 32-2 to the mixing chamber 50.

What is claimed is:

1. A dispensing system for a plural component mixture, the dispensing system including a first container, a dispensing device, second containers for each of the components, the second containers adapted to be placed within the first container, and conduits coupled between the second containers and the dispensing device, the first container adapted to be held by an operator during dispensing of plural component mixture from the dispensing device, a valve and a third container, the valve controlling the supply of a solvent from the third container with the plural component mixture to effect blending of an edge of a spray pattern formed by the plural component mixture on an article onto which the plural component mixture is being dispensed, the valve further being adapted to dispense the solvent from the third container to flush the plural component mixture from the dispensing device.

2. The apparatus of claim 1 wherein the second containers for each of the components comprise separate flexible containers.

3. The apparatus of claim 2 wherein the separate flexible containers comprise sealable resin or polymer bags.

4. The apparatus of claim 2 wherein the separate flexible containers are filled with respective components by a supplier.

5. The apparatus of claim 2 wherein the separate flexible containers are filled by the operator of the apparatus.

6. The apparatus of claim 1 wherein the first container includes a closure having a first connector for each of the plural components, and each second container includes a complementary second connector for cooperating with a respective first connector to couple the material in a respective second container to the dispensing device.

7. The apparatus of claim 1 further including means for pumping the components from their separate second containers through their respective separate conduits to the dispensing device.

8. The apparatus of claim 7 wherein the second containers for each of the components comprise separate flexible containers, and the means for pumping the components from their separate second containers through their respective separate conduits to the dispensing device includes means for pressurizing the first container.

9. The apparatus of claim 8 wherein the means for pressurizing the first container includes means for supplying to the interior of the first container a compressed gas or mixture of gases.

10. The apparatus of claim 1 wherein the third container is mounted on the dispensing device.

11. A dispensing system for a plural component mixture, the dispensing system including a dispensing device, first containers for each of the components, and conduits coupled between respective first containers and the dispensing device, the dispensing device including a passageway for the passage of each respective component through the dispensing device, each passageway including a valve, and an actuator for controlling the valves, thereby controlling the passage of the respective components through the dispensing device, a second valve and a second container mounted on the dispensing device, the second valve controlling the supply of a solvent from the second container, the second valve adapted to supply the solvent from the second container with the plural component mixture to effect blending of an edge of a spray pattern formed by the plural component mixture on an article onto which the plural component mixture is being dispensed, the second valve further being adapted to dispense the solvent to flush the plural components from the dispenser.

12. The apparatus of claim 11 wherein each valve includes a seat and a movable valve member, the actuator controlling the positions of the movable valve members.

13. The apparatus of claim 11 further including a third container, the first containers comprise separate flexible containers, and further including means for pumping the components from their separate flexible containers through their respective separate conduits to the dispensing device.

14. The apparatus of claim 13 wherein the separate flexible containers comprise sealable resin or polymer bags.

15. The apparatus of claim 13 wherein the means for pumping the components from their separate flexible containers through their respective separate conduits to the dispensing device includes means for pressurizing the third container.

16. The apparatus of claim 15 wherein the means for pressurizing the third container includes means for supplying to the interior of the third container a compressed gas or mixture of gases.

17. The apparatus of claim 13 wherein the third container is hand-held.

* * * * *